US009644499B2

(12) United States Patent
Byrd

(10) Patent No.: US 9,644,499 B2
(45) Date of Patent: May 9, 2017

(54) INSTANTLY RENEWED ENERGY SYSTEM

(71) Applicant: Noel Samuel Byrd, Lake Charles, LA (US)

(72) Inventor: Noel Samuel Byrd, Lake Charles, LA (US)

( * ) Notice: Subject to any disclaimer, the term of this patent is extended or adjusted under 35 U.S.C. 154(b) by 443 days.

(21) Appl. No.: 14/809,490

(22) Filed: Jul. 27, 2015

(65) Prior Publication Data

US 2016/0123189 A1 May 5, 2016

Related U.S. Application Data

(60) Provisional application No. 62/122,917, filed on Nov. 3, 2014.

(51) Int. Cl.

| | |
|---|---|
| ***F01K 3/18*** | (2006.01) |
| ***F24H 1/00*** | (2006.01) |
| ***F22B 1/28*** | (2006.01) |
| ***F01K 7/16*** | (2006.01) |

(52) U.S. Cl.

CPC ..... *F01K 3/186* (2013.01); *F01K 7/16* (2013.01); *F22B 1/28* (2013.01); *F22B 1/281* (2013.01); *F24H 1/0018* (2013.01); *F24H 2250/00* (2013.01); *F24H 2250/12* (2013.01)

(58) Field of Classification Search

CPC ..... F01K 3/186; F01K 7/16; F24H 1/0018; F24H 2250/12; F24H 2250/00; F22B 1/281; F22B 1/28

USPC ..... 60/677–680; 122/4 A, 26

See application file for complete search history.

(56) References Cited

U.S. PATENT DOCUMENTS

| | | | | |
|---|---|---|---|---|
| 1,420,693 | A * | 6/1922 | Cohen | F22B 1/284 392/401 |
| 1,902,842 | A * | 3/1933 | Eaton | F22B 1/30 392/326 |
| 5,914,065 | A * | 6/1999 | Alavi | F24J 3/00 219/630 |
| 6,295,411 | B1 * | 9/2001 | Fastman | F24H 9/0042 122/4 A |
| 2010/0122489 | A1 * | 5/2010 | Hayes | C10L 1/00 44/639 |

OTHER PUBLICATIONS

International Search Report and Written Opinion in related International patent application No. PCT/US2015058103, mailed Jan. 20, 2016, 6 pages.

* cited by examiner

*Primary Examiner* — Hoang Nguyen
(74) *Attorney, Agent, or Firm* — Law Office of Jeff Williams; J. Oliver Williams

(57) ABSTRACT

The present application includes a condensing steam turbine used to produce power without the need to consume fossil fuels. The steam turbine includes a plurality of stage wheels, heating coils, and closed circular loops. Energy is provided to the heating coils and the closed circular loops to generate heat. The heat is cycled to produce power. The heating coils and the loops are located in a housing in an overlapping and alternating configuration. The loops are made of two or more magnets joined at opposing poles.

10 Claims, 4 Drawing Sheets

28. To Control Panel
29. Feedwater Pipe
30. Microwave Units
31. Leads to Control Panel
32. Leads to Item #4
33. Heat Coil Leads
34. Boiler
35. Nozzle to Item #10
36. Leads to Item #4
37. Control Valve Chest and Solenoid
39. Heater 24. Closed Circular Loops
25. Internal Heating Coils
26. Brackets
27. Brackets

INSTANTLY RENEWED ENERGY SYSTEM

BACKGROUND

1. Field of the Invention

The present application relates generally to an energy system, and in particular to a renewable energy system.

2. Description of Related Art

In a study ordered by Congress, the Environmental Protection Agency found a global warming trend caused by the Greenhouse Effect. The so-called Greenhouse Effect is caused by emissions of polluting gases from the combustion of fossil fuels. Automobiles and energy production are the main polluters. Because of its devastating effect-on the environment, the Greenhouse Effect is one of the most threatening problems faced by Man. In America, the importing of oil has is another problem that has contributed a great deal to the trade deficit. Existing fossil fuel systems pollute the air and as a mechanical system tend to wear more quickly than electronic systems.

It is desired that there be a safe and effective way to avoid the use of fossil fuels and generate reliable energy at the same time. Although great strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
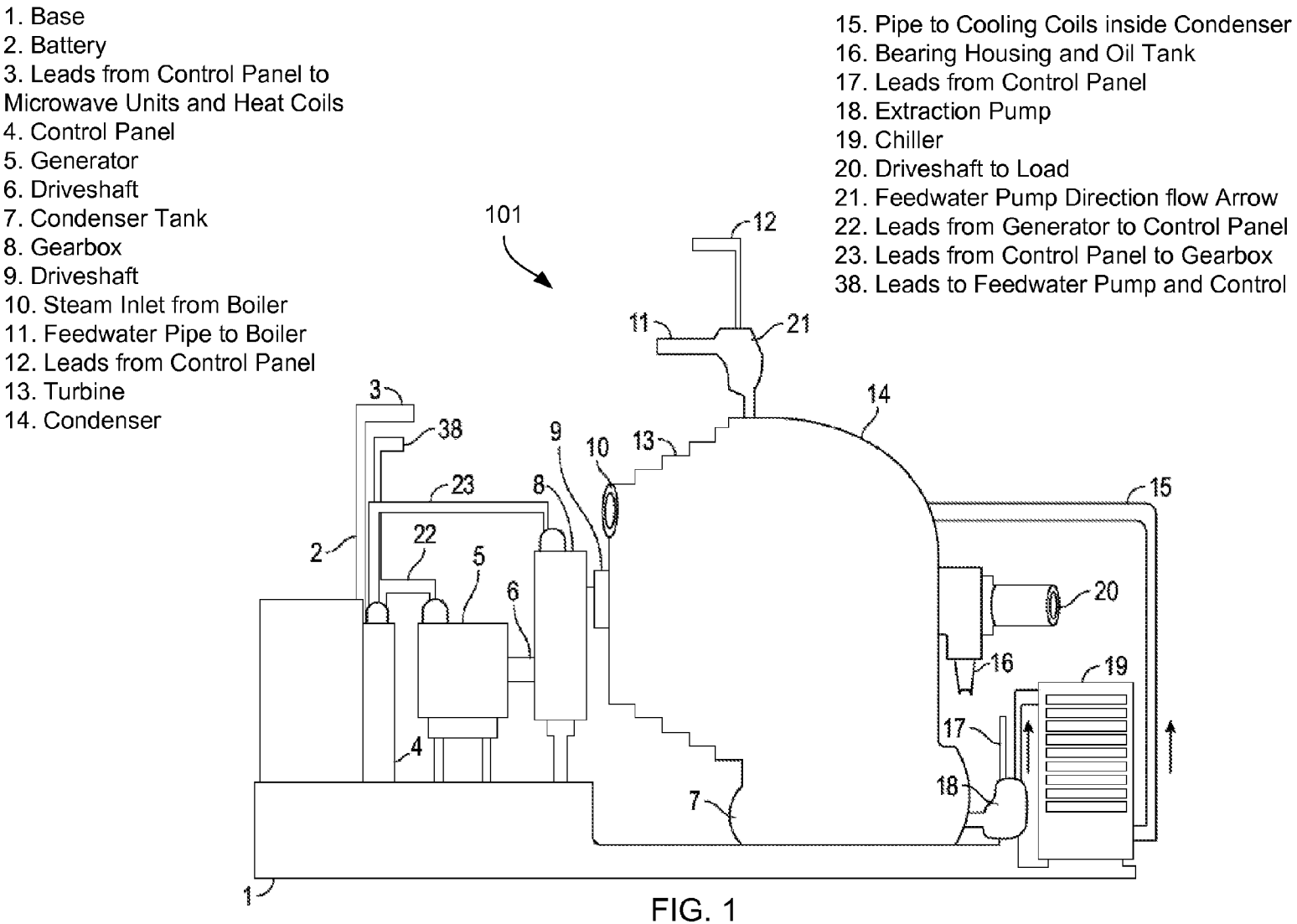
FIG. 1 is a side view of an instantly renewed energy system according to the preferred embodiment of the present application.
Figure 2:
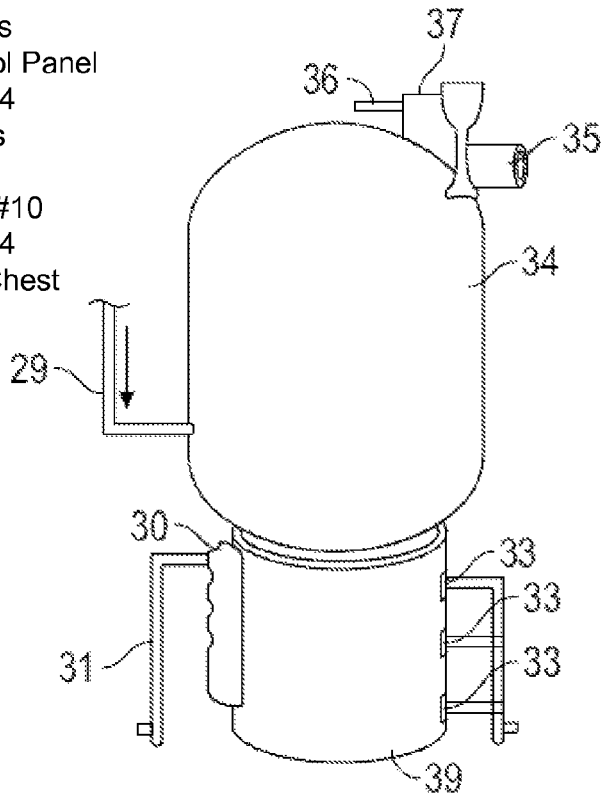
FIG. 2 is a side view of a boiler used in the energy system of FIG. 1.
Figure 3:
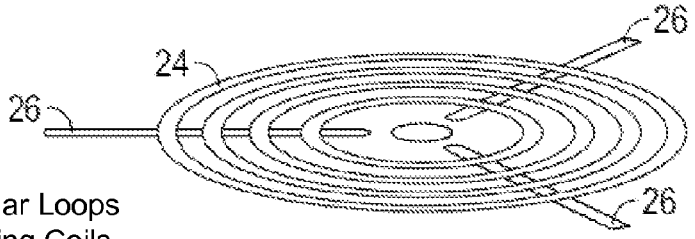
FIG. 3 is a top view of a closed circular loop in the energy system of FIG. 1.
Figure 4:
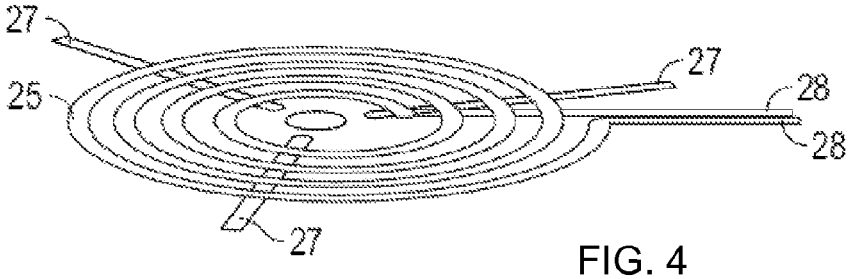
FIG. 4 is a top view of an internal heating coil in the energy system of FIG. 1.
Figure 6:
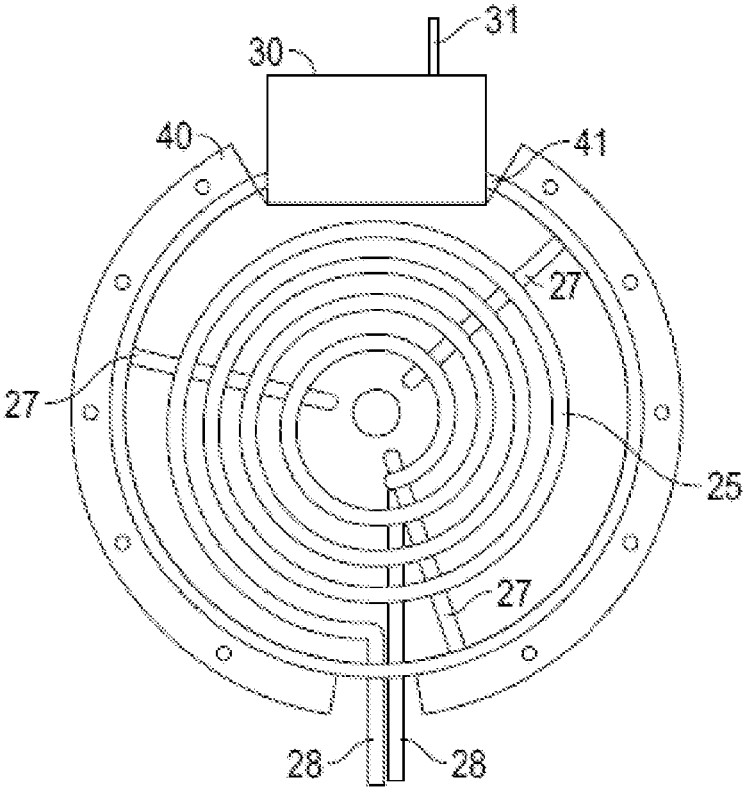
FIG. 6 is a detailed view of the internal heating coil of FIG. 4.
Figure 5:
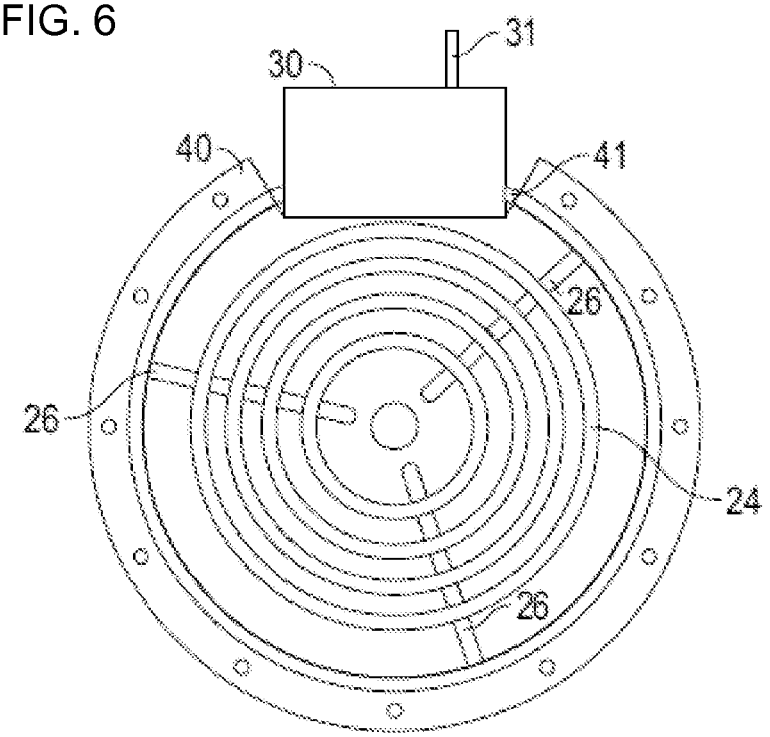
FIG. 5 is a detailed view of the closed circular loop of FIG. 3.
Figure 7:
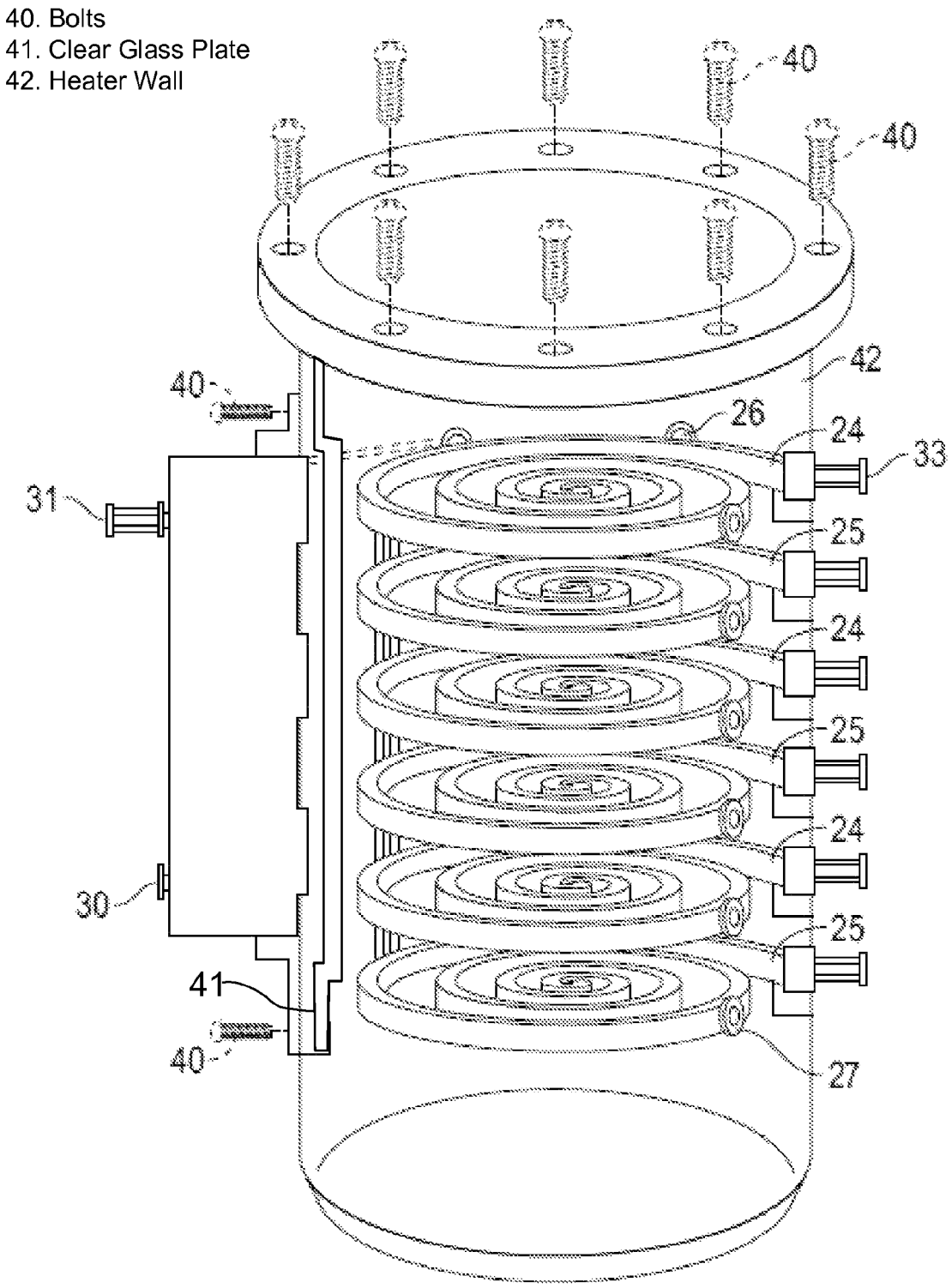
FIG. 7 is a partial side view of the heater of FIG. 2 showing the alternating layout configuration of the circular loops of FIG. 3 with the heating coils of FIG. 4.

While the system of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The assembly in accordance with the present application overcomes one or more of the above-discussed problems commonly associated with conventional energy producing systems. The system of the present application is configured to provide power from the use of electrical and magnetic forces. The system is configured to recycle energy from one stage to another so as to conserve energy losses. These and other unique features of the assembly are discussed below and illustrated in the accompanying drawings.

The system will be understood, both as to its structure and operation, from the accompanying drawings, taken in conjunction with the accompanying description. Several embodiments of the assembly are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The system of the present application is illustrated in the associated drawings. The assembly includes a number of common elements associated with conventional energy systems. The present system includes a condensing steam turbine with a plurality of stage wheels. The turbine includes a heater wall having a plurality of internal heating coils and a plurality of closed circular loops, both configured to supply heat to the system. The coils and the circular loops are arranged within a volume of space within the heater walls in an alternating configuration.

Referring now to the drawings wherein like reference characters identify corresponding or similar elements in form and function throughout the several views. FIG. 1 illustrates an instantly renewed energy system 101 according to the present application. System 101 offers a solution to both problems. This device does not consume fossil fuels and produces no emissions of gases to pollute the air. These are two distinct advantages over conventional power sources. This device produces approximately 353 horsepower at 6500 rpm. It would be about the same size and weight of a 400 cubic inch displacement gasoline or diesel engine. System 101 could be used in the same applications as conventional internal combustion engines.

Since there is no rapid oxidation, system 101 doesn't wear out or deteriorate as rapidly as conventional fossil fuel engines. Internal heating is also more efficient than externally heating a boiler.

The heating elements would be replaced after approximately 750,000 hours of operation. This would vary according to conditions. Different materials would be tested to determine the more efficient material.

The heater elements are used in a way that is similar to a conventional nuclear reactor's cobalt rods. System 101 uses electro-magnetic radiation as opposed to the organic (uranium, plutonium) radiation of a nuclear power plant. It is much safer and on a smaller scale.

Just as fossil fuels are consumed in the production of energy, so are the ferrous based heater elements consumed, but at a much slower scale than fossil fuels. System 101 is not a so-called perpetual energy system any more a nuclear reactor is. Nuclear reactors were once thought to be a perpetual energy device because fuel consumption wasn't readily apparent. So it is with system 101.

FIG. 1 shows system 101 as using a conventional steam turbine along with various state of the art devices. FIGS. 2-7 illustrate detailed views of components within system 101. Each component is numbered and known devices are not shown in detail, only in their relationship to the overall invention. The unique feature in this is its method of heating the steam, therefore these features are more clearly depicted in the Figures. Other components shown are in abstract form.

FIG. 1 is a five stage double row wheel condensing steam turbine. The turbine produces 366 kw/hr. of power at 6500 RPM. Initial. Conditions are 6000 p.s.i. at 900 degrees Fahrenheit. The steam rate is 3,500 lbs/hr. The first stage wheel is 9 inches in diameter, the second row is 9.5 inches in diameter, the third row is 9.75 in. diameter, the fourth row is 10 in. diameter, and the fifth row is 10.s in. diameter.

The heat is supplied by three internal heating coils 25 and three sets of closed circular loops 24 which are made of permanent magnets. The magnetic loops 24 are made by coupling two magnetic half-circle rods together with opposite poles joined together (N-S), (S-N). This creates an internal magnetic flux flow inside the loops 24 from S to N.

The D.C. current flow in the coils 25 is from negative to positive and is in the same direction as the flow in the magnetic loops 24. The D.C. current flow creates a magnetic flux field around the coil 25 which cuts across the magnetic loops 24 in the same direction.

The electromagnetic radio waves from microwave transmitting units 30 cut across the magnetic loops 24 and produce a current flow inside the loops 24 in accordance with Faraday's Law. The radio frequency range would be between 10,000 MHz and 24,000 MHz. The radio frequency would vary according to temperature needs. The magnetic flux flow inside the loops 24 amplifies the current flow created by waves from the microwave transmitters 30. The magnetic flux field from the D.C. current. in the heat coils 25 is opposed by the electromagnetic radio waves from the microwave transmitting unit 30 with each cycle (10,000 MHz to 24,000 MHz, and is neutralized between cycles. This induces a current flow in the loops 24. The coils 25 and the closed circular loops 24 are the heating elements.

The heating elements are secured with insulating brackets 26, 27 which are fastened to the inside of the heater 39. The microwave units 30 are fastened to the outside wall of the heater 39. The radio waves travel through a clear glass plate 41. The glass plate 41 is heat resistant and can withstand 2,000 p.s.i. of pressure. This produces the heat for the boiler 34. Since the steam is heated internally, it utilizes 95% of the applied heat. Conventional fossil fuel turbines only use 40%, the rest is lost to the atmosphere.

The power consumed for heating, totals 11.4 KW. Initially the power for the heat coils 25 and microwave units 30 is supplied by a 48 volt 200 amp battery 2. Once in operation, power is to the coil 25 by a 15 KW generator 5 driven by the turbine driveshaft 6 through a gearbox 8. This generator 5 is used to charge the battery 2 and drive the electric feedwater 21 and extraction pumps 18.

The water is extracted from the condenser 14 wall through a series of coils inside the condenser 14 and through an external chiller 19 to cool the steam and also pre-heat the boiler feedwater to 200 degrees F. The microwave units 30 are fitted into the heater 39 wall. Insulation of the boiler wall prevents heat dissipation.

The heating elements consume 11.4 KW and the two pumps consume 2.8 KW for a total of 14.2 KW. This is subtracted from 368 KW for a net total of 353.8 KW or 477.4 horsepower.

Components that operate the solenoids for the turbine control valve chest 37, switch power from the battery 2 to the generator 5 and operate the feed water pumps 21 are located in a central control cabinet 4.

Size and power variations may be made in this engine to increase or decrease its power output. The microwave frequency may vary to produce maximum heat output from the closed loops 24 and coils 25.

Since this engine does not consume fossil fuels and it uses electromechanical radiation instead of organic radiation (uranium, plutonium, etc.), its advantages are quite obvious.

The number and positioning of the heating coils 25 and loops 24 may vary to attain maximum efficiency.

The heater 39 is secured to the bottom of the boiler 34 with bolts 40. The internal positioning of the heat coils 25 and closed loops 24 and the microwave units 30 are shown in detail in the Figures. In addition to heating the coils and the loops 24, the microwave units 30 heat the water in the same manner as a regular microwave oven.

Matter placed in the path of microwave radio frequency heat up according to the molecular structure, density and the conductivity of the matter. Basically, the more a material conducts electricity, the hotter it gets. The closed magnetic loops 24 have the ferric electrons aligned and are ionized by the internal magnetic flux flow inside the loops 24. The radio frequency causes heat to build in high concentrations inside the loops 24 and coils 25 by ferromagnetic action.

The current application has many advantages over the prior art including at least the following: (1) use of an edge treatment to increase strength and prevent folding, bunching, and rolling of the edge; (2) customizable nature to fit any shape and size; (3) ability to reuse and recycle individual parts of the assembly; and (4) the ability to prevent the slippage of a cushion on a furniture member.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application.

Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A steam turbine system for generating power, comprising:

a plurality of stage wheels;

a plurality of heating coils located within a housing and configured to supply heat for power generation; and a plurality of closed circular loops located in the housing and configured to supply heat for power generation, the loops made of two or more magnets, the loops formed from the joining of the magnets wherein the opposite poles of the magnets are joined together;

wherein power is generated by selectively routing energy through the plurality of heating coils and plurality of closed circular loops.

2. The system of claim 1, wherein the magnets create an internal magnetic flux inside the loop.

3. The system of claim 1, wherein the internal heating coils receive a direct current flow from negative to positive to create a magnetic flux field.

4. The system of claim 3, wherein the magnetic flux field of the heating coils cut across the plurality of circular loops.

5. The system of claim 1, further comprising:

a microwave transmitting unit in communication with the heating coils and the circular loops and being configured to transmit electromagnetic radio waves across the magnetic circular loops to produce a current flow inside the magnetic circular loops.

6. The system of claim 5, wherein the current in the heating coils is opposed by the electromagnetic radio waves from the transmitting unit.

7. The system of claim 1, wherein plurality of heating coils and the plurality of circular loops are aligned in an alternating overlaying configuration.

8. The system of claim 7, wherein the configuration involves positioning each of the circular loops between the plurality of heating coils.

9. The system of claim 1, wherein the numbering and positioning of the plurality of heating coils and the plurality of circular loops is varied to attain maximum efficiency.

10. The system of claim 1, wherein the energy supplied to the heating coils and the circular loop is made without the use of fossil fuels.

* * * * *